US009259090B1

(12) United States Patent
Cronin

(10) Patent No.: US 9,259,090 B1
(45) Date of Patent: Feb. 16, 2016

(54) INSULATED COOLER WITH DUAL DISPENSING CHUTES

(71) Applicant: Jennifer Dawn Cronin, Fort Smith, AR (US)

(72) Inventor: Jennifer Dawn Cronin, Fort Smith, AR (US)

( * ) Notice: Subject to any disclaimer, the term of this patent is extended or adjusted under 35 U.S.C. 154(b) by 0 days.

(21) Appl. No.: 14/510,612

(22) Filed: Oct. 9, 2014

Related U.S. Application Data

(60) Provisional application No. 61/890,138, filed on Oct. 11, 2013.

(51) Int. Cl.

| | |
|---|---|
| ***A47C 7/62*** | (2006.01) |
| ***A47C 1/14*** | (2006.01) |
| ***F25D 3/08*** | (2006.01) |
| ***B65D 81/38*** | (2006.01) |
| ***A47C 7/54*** | (2006.01) |
| ***A47C 7/40*** | (2006.01) |

(52) U.S. Cl.
CPC ..... *A47C 1/146* (2013.01); *A47C 7/407* (2013.01); *A47C 7/54* (2013.01); *A47C 7/62* (2013.01); *B65D 81/38* (2013.01); *F25D 3/08* (2013.01)

(58) Field of Classification Search
CPC ..... A47C 4/52; A47C 7/62; A47C 15/004; A47C 1/146; A47C 7/54; A47C 7/407; F25D 3/08; B65D 81/38
USPC ..... 297/217.1, 217.7, 188.08; 220/592.05, 220/592.03, 592.1, 592.01, 592.02; 206/139, 427, 429; 62/457.1, 447, 441
See application file for complete search history.

(56) References Cited

U.S. PATENT DOCUMENTS

| | | | | | |
|---|---|---|---|---|---|
| 2,812,227 | A | * | 11/1957 | Hill | 312/290 |
| 4,974,426 | A | * | 12/1990 | Gomez et al. | 62/457.7 |
| 5,269,157 | A | * | 12/1993 | Ciminelli et al. | 62/457.7 |
| 5,295,369 | A | * | 3/1994 | Garcia | 62/389 |
| 5,727,844 | A | * | 3/1998 | O'Quinn et al. | 297/217.1 |
| 6,341,817 | B1 | * | 1/2002 | Stern-Gonzalez | 297/188.1 |
| 7,604,290 | B1 | * | 10/2009 | Giordano | 297/188.1 |
| 7,810,350 | B2 | * | 10/2010 | Shelton | 62/457.5 |
| D646,528 | S | * | 10/2011 | Stallman et al. | D7/605 |

* cited by examiner

*Primary Examiner* — Milton Nelson, Jr.
(74) *Attorney, Agent, or Firm* — Williams Intellectual Property; Benjamin F. Williams

(57) ABSTRACT

An insulated cooler with dual dispensing chutes including an insulated housing having a seating portion disposed thereatop, the seating portion bounded by a three-sided perimeter, wherein each of a pair of dispensing chutes is disposed through an insulated interior cavity between a top hatch, disposed in the three-sided perimeter, and a bottom hatch, disposed in a respective one of a pair of second walls, whereby expedient access to chilled beverages is enabled when each bottom hatch is opened and a beverage is volubly dispensed therefrom to a user seated atop the housing.

8 Claims, 3 Drawing Sheets

INSULATED COOLER WITH DUAL DISPENSING CHUTES

This application claims the benefit of provisional application No. 61/890,138 filed on Oct. 11, 2013.

BACKGROUND OF THE INVENTION

Various types of insulated coolers are known in the prior art. However, what is needed is an insulated cooler with dual dispensing chutes that includes an insulated housing having a seating portion disposed thereatop, said seating portion bounded by a three-sided perimeter, wherein each of a pair of dispensing chutes is disposed through an insulated interior cavity between a top hatch, disposed in the three-sided perimeter, and a bottom hatch, disposed in a respective one of a pair of second walls, whereby expedient access to chilled beverages is enabled when each bottom hatch is opened and a beverage is volubly dispensed therefrom to a user seated atop said housing.

FIELD OF THE INVENTION

The present invention relates to an insulated cooler with dual dispensing chutes, and more particularly, to an insulated cooler with dual dispensing chutes that includes an insulated housing having a seating portion disposed thereatop, said seating portion bounded by a three-sided perimeter, wherein each of a pair of dispensing chutes is disposed through an insulated interior cavity between a top hatch, disposed in the three-sided perimeter, and a bottom hatch, disposed in a respective one of a pair of second walls, whereby expedient access to chilled beverages is enabled when each bottom hatch is opened and a beverage is volubly dispensed therefrom to a user seated atop said housing.

SUMMARY OF THE INVENTION

The general purpose of the insulated cooler with dual dispensing chutes, described subsequently in greater detail, is to provide an insulated cooler with dual dispensing chutes which has many novel features that result in a insulated cooler with dual dispensing chutes which is not anticipated, rendered obvious, suggested, or even implied by prior art, either alone or in combination thereof.

The present insulated cooler with dual dispensing chutes enables expedient access to a beverage from each of a pair of dispensing chutes disposed interiorly within an insulated housing, whereby a chilled beverage is accessible to a user seated atop said insulated housing, without said user having to stand or relocate relative said housing.

The present insulated cooler with dual dispensing chutes thereby provides a seat for a user while enabling access to chilled beverages, as desired, said beverages stored in chilled and dispensable situation within the insulated housing.

The present insulated cooler with dual dispensing chutes, therefore, is usable as a comfortable seat at sporting events, for example, at festivals, on boats, and at other activities where portable storage of chilled beverages is enjoyable.

The present insulated cooler with dual dispensing chutes, therefore, includes an insulated housing having a plurality of walls disposed upon a base. The plurality of walls includes a parallel pair of first walls joined endwise with a parallel pair of second walls. A lid, hingedly attached at one of the pair of first walls, sealably encloses an interior cavity when moved to a closed position.

The lid includes a seating portion disposed thereupon. The seating portion includes a seat, disposed in parallel with the lid, and a back member. The back member is moveable between a lowered position, covering the seat, and a raised position, disposed extending upward therefrom. When moved to the raised position, the back member is supportive of the back of a user occupying the seat.

A three-sided perimeter is disposed upon the lid, said three-sided perimeter disposed in raised situation relative the seat. The three-sided perimeter includes a pair of side portions, disposed on either side of the seat, and a rear portion, disposed behind the seat. A user occupying the seat may use each of the pair of side portions as arm rests, as desired.

A pair of recessed cup holders is disposed in the three-sided perimeter, each of said pair of cup holders disposed cornerwise therein at a position where one of the pair of side portions adjoins the rear portion. A user, seated in the seat, is enabled position and retrieval of beverages supportively disposed in each of the pair of recessed cup holders, as desired.

Each of a pair of dispensing chutes is disposed in the interior cavity, each of said pair of dispensing chutes disposed downwards from an open end disposed in a respective one of the pair of side portions of the three-sided perimeter. Each of the pair of dispensing chutes includes a top hatch, openable in the three-sided perimeter, and a bottom hatch disposed proximal the housing base and openable in a respective one of the pair of second walls.

Beverages are thus storable in stacked, horizontal situation in each of the pair of dispensing chutes, and are volubly dispensable therefrom when a respective one of the bottom hatches is opened. A user occupying the seat, therefore, may expediently access a beverage from each of the pair of dispensing chutes when each of the bottom hatches is opened.

Ice, or other coolant additional to the interior cavity, conducts heat from each of the pair of dispensing chutes and cools any beverages placed therein. Thus a user stocks the interior cavity with ice, or other coolant, secures the lid in the closed position, and subsequently positions a plurality of beverages in each of the pair of dispensing chutes. The present insulated cooler with dual dispensing chutes thence enables a comfortable seat for use, as desired, when attending a sporting event, for example, a festival, or engaging in any activity where portable storage of chilled beverages is desirable.

Thus has been broadly outlined the more important features of the present insulated cooler with dual dispensing chutes so that the detailed description thereof that follows may be better understood and in order that the present contribution to the art may be better appreciated.

Objects of the present insulated cooler with dual dispensing chutes, along with various novel features that characterize the invention are particularly pointed out in the claims forming a part of this disclosure. For better understanding of the insulated cooler with dual dispensing chutes, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
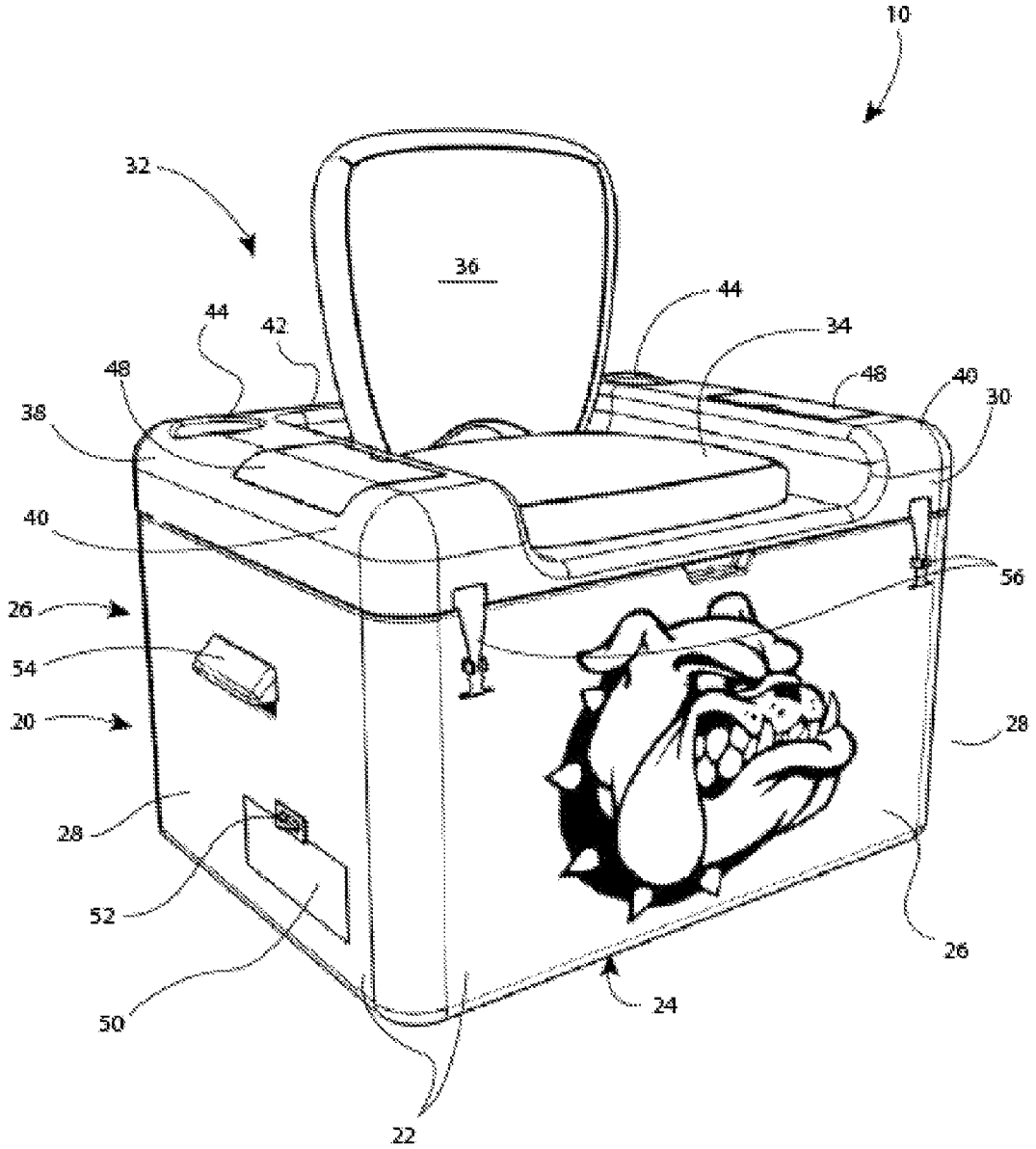
FIG. 1 is an isometric view of an embodiment.
Figure 2:
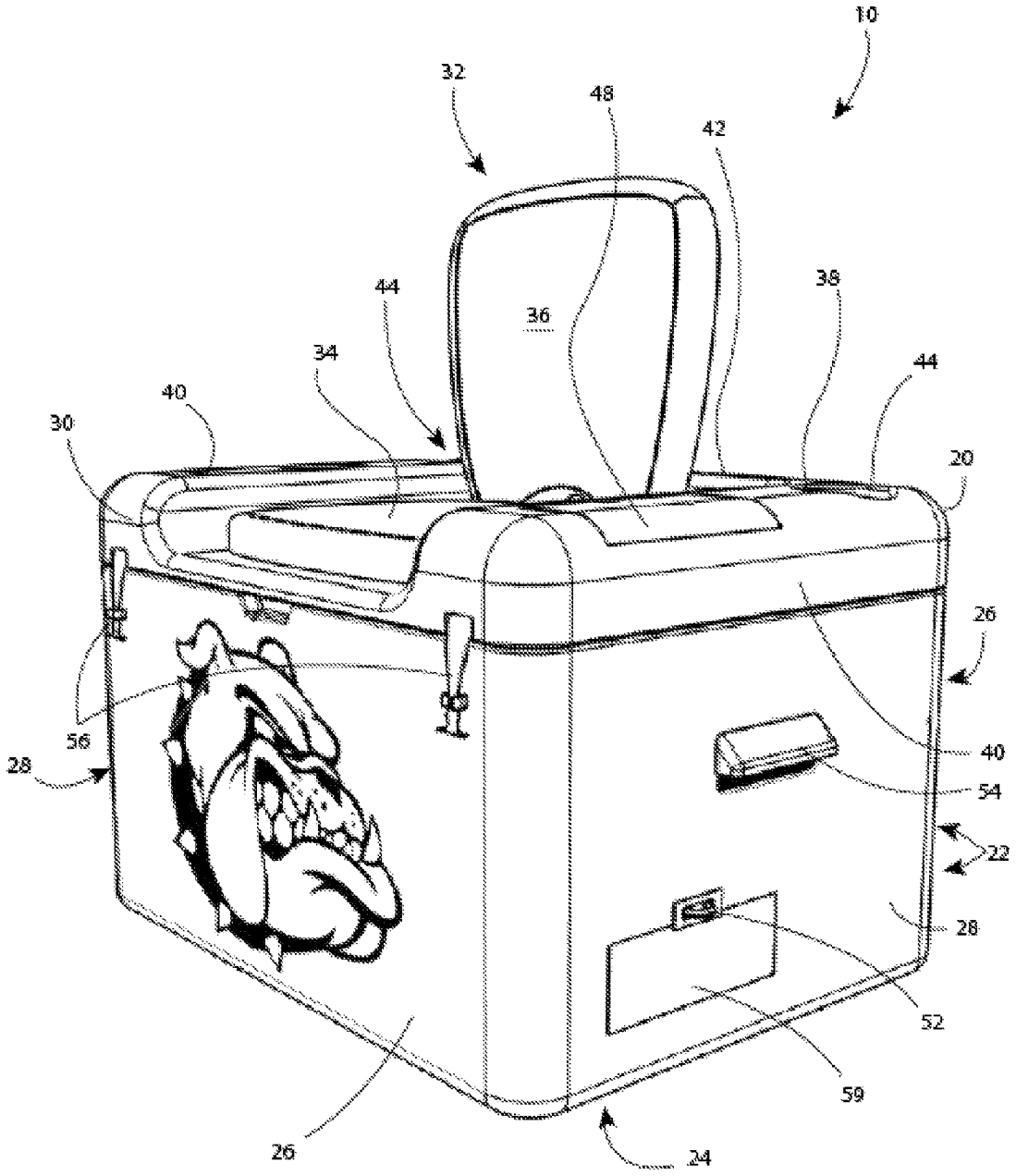
FIG. 2 is an isometric view of an embodiment.
Figure 3:
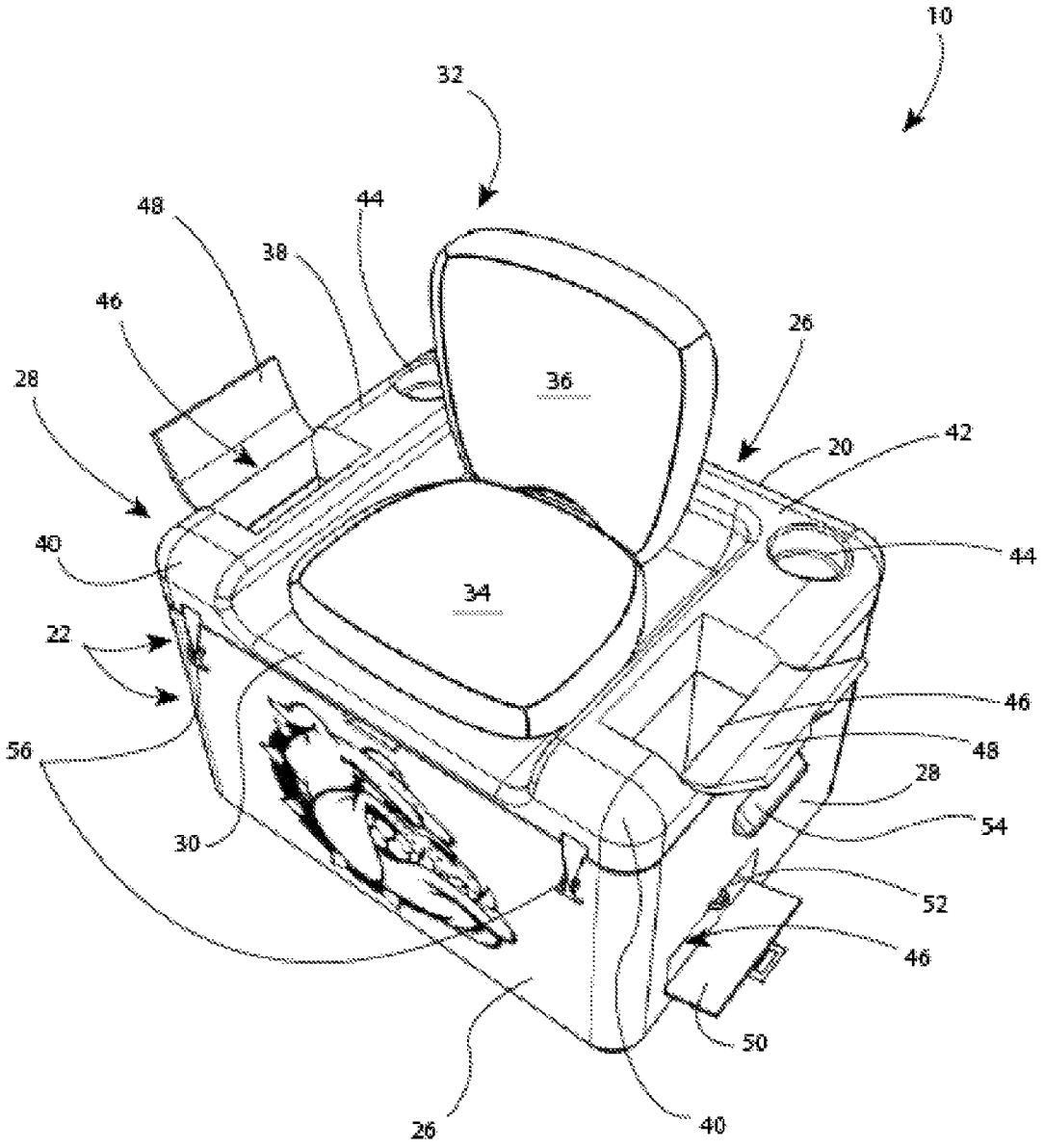
FIG. 3 is an elevation view of an embodiment.

With reference now to the drawings, and in particular FIGS. 1 through 3 thereof, example of the instant insulated cooler with dual dispensing chutes employing the principles and concepts of the present insulated cooler with dual dispensing chutes and generally designated by the reference number 10 will be described.

Referring to FIGS. 1 through 3 a preferred embodiment of the present insulated cooler with dual dispensing chutes 10 is illustrated.

The present insulated cooler with dual dispensing chutes 10 enables a sedentary user, seated upon a seating portion disposed atop an insulated housing, access to each of a pair of dispensing chutes, wherein beverages are dispensable from an insulated interior without said user having to stand.

The present insulated cooler with dual dispensing chutes 10 includes an insulated housing 20 having a plurality of walls 22 disposed vertically adjoined atop a base 24. The plurality of walls 22 includes a parallel pair of first walls 26 joined endwise to a parallel pair of second walls 28. A lid 30 is hingedly attached to one of the pair of first walls 26 and is moveable between an open position and a closed position whereby an interior cavity is sealably enclosable, as desired.

A seating portion 32 is disposed atop the lid 30. The seating portion 32 is disposed recessed into the lid 30 and includes a horizontal seat 34 and a back member 36. The back member 36 is positional between a horizontal position, overlying and covering the seat 34, and a raised position, upwardly extended therefrom. When moved to the raised position, the back member 36 is supportive of the back of a user seated upon the seat 34.

The lid 30 includes a three-sided perimeter 38 bordering the seating portion 32 in a raised position relative the seat 34. The three-sided perimeter 38 includes a pair of side portions 40, disposed on either side of the seat 34, and a rear portion 42, disposed behind the seat 34. A user seated upon the seat 34 may use each of the pair of side portions 40 as an arm rest.

Each of a pair of recessed cup holders 44 is disposed in the three-sided perimeter 38, cornerwise at a position where a respective one of the pair of side portions 40 adjoins the rear portion 42. A user, occupying the seat 34, may expediently position and retrieve beverages disposed within each of the pair of recessed cup holders 44.

Each of a pair of dispensing chutes 46 is disposed downwards from each of the pair of side portions 40 of the three-sided perimeter 38. Each of the pair of dispensing chutes 46 includes a top hatch 48, openable within the three-sided perimeter 38, and a bottom hatch 50, disposed proximal the base 24 and openable in a respective one of the pair of second walls 28. Each bottom hatch 50 is securable in closed situation by means of a latch 52.

Each of the pair of dispensing chutes 46 orients a stack of beverages, loaded therein, within the interior cavity. Ice, or other coolant additional to the interior cavity, conducts heat from each of the pair of dispensing chutes 46 whereby heat is conducted from any beverages stored therein.

A user, therefore, stocks each of the pair of dispensing chutes 46 with a suitable number of horizontally aligned beverages by opening each respective top hatch 48, as desired. Once seated upon the seating portion 32 of the device 10, a user may expediently access a beverage from either of the pair of dispensing chutes 46 by opening a respective one of the bottom hatches 50, whereby a beverage is volubly dispensed therefrom by gravity.

For portability of the present insulated cooler with dual dispensing chutes 10, each of a pair of handles 54 is exteriorly disposed upon each of the pair of second walls 28. For security of the interior cavity during portage or relocation of the housing 20, and to maintain sealed enclosure of the interior cavity when desired, a pair of fasteners 56 secure the lid 30 in the closed position.

What is claimed is:

1. An insulated cooler with dual dispensing chutes comprising an insulated housing having a seating portion recessed upon a lid attached thereatop, said seating portion bounded by a three-sided perimeter having a pair of dispensing chutes disposed therein, each of said pair of dispensing chutes disposed through an insulated interior cavity between a top hatch, disposed in the three-sided perimeter, and a bottom hatch, disposed in a respective one of a pair of second walls proximal a base of the insulated housing, wherein expedient access to chilled beverages is enabled when each bottom hatch is opened and a beverage, additional to the respective dispensing chute, is volubly dispensed therefrom for ready retrieval by a user seated atop said housing.

2. The insulated cooler with dual dispensing chutes of claim 1 wherein the seating portion includes a horizontal seat and a back member moveable between a horizontal position and a raised position whereby said back member is moveable to the raised position to support a back of a user when seated upon the horizontal seat.

3. The insulated cooler with dual dispensing chutes of claim 2 wherein the three-sided perimeter comprises a pair of side portions disposed endwise perpendicularly from a rear portion, each of said pair of side portions usable as an arm rest for a user when seated upon the seating portion.

4. The insulated cooler with dual dispensing chutes of claim 3 further comprising a pair of recessed cup holders disposed in the three-sided perimeter cornerwise at a position where each side portion adjoins the rear portion.

5. The insulated cooler with dual dispensing chutes of claim 4 wherein each bottom hatch is securable in a closed position flush with the insulated housing by action of a latch.

6. The insulated cooler with dual dispensing chutes of claim 5 wherein the insulated housing further comprises a pair of handles exteriorly disposed thereupon effective for portage of said insulated housing.

7. The insulated cooler with dual dispensing chutes of claim 6 further comprising a pair of fasteners disposed to secure the lid in a closed position.

8. An insulated cooler with dual dispensing chutes comprising:

an insulated housing having a plurality of walls disposed atop a base, said plurality of walls including:
- a parallel pair of first walls;
- a parallel pair of second walls;

an interior cavity disposed within the insulated housing;

a lid disposed atop one of the plurality of walls, said lid enclosing the interior cavity;

a seating portion disposed atop the lid, said seating portion recessed into the lid and bounded by a three-sided perimeter having a pair of side portions and a rear portion, said seating portion including:
- a horizontal seat;
- a back member moveable between a horizontal position and a raised position;

a pair of recessed cup holders disposed in the three-sided perimeter, each of said pair of recessed cup holders disposed therein cornerwise at a position where a respective one of the pair of side portions adjoins the rear portion;

each of a pair of dispensing chutes disposed downwards in each of the pair of side portions of the three-sided perimeter terminable at each of the pair of second walls proximal the base of the insulated housing;

a top hatch disposed openable atop each of the pair of dispensing chutes;

a bottom hatch disposed at the bottom of each of the pair of dispensing chutes, said bottom hatch openable in each of the pair of second walls and securable in closed situation therein by means of a latch;

each of a pair of handles exteriorly mounted upon each of the pair of second walls; and a pair of fasteners disposed to secure the lid in a closed position;

wherein each of the pair of dispensing chutes is stockable with a plurality of horizontally aligned can beverages dispensible under the influence of gravity from each bottom hatch, whereby heat is conductable from each of the pair of dispensing chutes into the interior cavity of the insulated housing when ice or other cooling material is additional thereto, and chilled beverages are thereby conveniently volubly dispensable at each bottom hatch for ready retrieval by a user when seated atop the seating portion.

* * * * *